United States Patent [19]

Kobayashi

[11] 4,442,773

[45] Apr. 17, 1984

[54] PRINTING MODE SHIFTING DEVICE FOR BLANKET CYLINDERS IN OFFSET ROTARY PRESS

[75] Inventor: Haruyoshi Kobayashi, Yokohama, Japan

[73] Assignee: Kabushiki Kaisha Tokyo Kikai Seisakusho, Tokyo, Japan

[21] Appl. No.: 463,672

[22] Filed: Feb. 4, 1983

Related U.S. Application Data

[63] Continuation of Ser. No. 193,085, Oct. 2, 1980, abandoned.

[30] Foreign Application Priority Data

Feb. 6, 1980 [JP] Japan ..... 55-13268

[51] Int. Cl.[3] ..... B41F 5/06; B41F 7/12; B41F 13/36

[52] U.S. Cl. ..... 101/177; 101/180; 101/182; 101/218

[58] Field of Search ..... 101/177, 180, 176, 178, 101/179, 181, 182, 220, 221, 222, 223, 224, 225, 137, 138, 139, 140, 143, 247, 144

[56] References Cited

U.S. PATENT DOCUMENTS 3,329,086 7/1967 Pullen ..... 101/179
4,218,972 8/1980 Fujishiro ..... 101/177
4,281,595 8/1981 Fujishiro ..... 101/180

*Primary Examiner*—J. Reed Fisher

[57] ABSTRACT

In an offset rotary printing press which is equipped with a pair of blanket cylinders which can be shifted between two ultimate positions, in which one is a blanket to blanket type printing mode with four series-contacting cylinders exclusive of an impression cylinder and the other is a satellite type printing mode with five series-contacting cylinders including the impression cylinder, the blanket cylinders can be shifted between the two ultimate positions via two intermediate throw-off positions by three strokes of an actuator with switching by a clutch.

The amount of displacement of each of the blanket cylinders between the two ultimate positions exceeds the tooth height of driving gears for the blanket cylinders and the cylinders contacting with said blanket cylinders.

In the two intermediate throw-off positions a first intermediate throw-off position is provided close to a first ultimate position and a second intermediate throw-off position is provided close to a second ultimate position, and each gearing at the intermediate throw-off positions keeps within each gear train in the ultimate position thereto.

4 Claims, 19 Drawing Figures

PRINTING MODE SHIFTING DEVICE FOR BLANKET CYLINDERS IN OFFSET ROTARY PRESS

This is a continuation of application Ser. No. 193,085, filed Oct. 2, 1980, now abandoned.

BACKGROUND OF THE INVENTION

1. Field of the Invention

The present invention relates to a printing mode shifting device for offset printers wherein blanket to blanket type printing with four cylinders excluding an impression cylinder in contact with one another in series and satellite type printing with five cylinders including the impression cylinder in contact with one another in series are carried out, comprising a means for shifting the first printing mode to the second printing mode, and vice versa, the shifting means permitting a pair of blanket cylinders to be displaced with respect to each other and with respect to the other cylinders, the shifting means also permitting the pair blanket cylinders to be separated from each other and from the other cylinders so as to set the pair of cylinders in intermediate positions, i.e. intermediate throw-off positions.

2. Description of the Prior Art

In conventional offset printers wherein both blanket to blanket type printing and satellite type printing are carried out, the shifting of the blanket to blanket type printing mode to the satellite type printing mode cannot be completely carried out by displacing the pair of blanket cylinders alone. It requires another means which is not operatively connected to a means for displacing the pair of blanket cylinders. Such an additional means consists of a means for axially displacing one of two gears for the impression cylinder and one of a pair of gears for the pair blanket cylinders (refer to FIGS. 7 and 8 of U.S. Pat. No. 3,329,086), or a means for displacing an impression cylinder mechanism including a gear therefor toward and away from the pair of blanket cylinders (refer to FIGS. 9 and 10 of the above-mentioned patent). Therefore, it is troublesome to control such an offset printer, and control errors possibly occur. When control errors occur, the driving system may be greatly damaged.

If the printing modes can be shifted from one to the other by merely displacing the pair of blanket cylinders, and if the driving systems for the pair of blanket cylinders are also automatically shifted in accordance with the displacement of the blanket cylinders, a desired printing mode is obtained by one action so that a mechanism for engaging and disengaging driving gears can be omitted. This allows the construction of an offset printer of this kind to be simplified, and control errors never occur.

The above-mentioned drawbacks encountered in a conventional printing mode shifting device resides in the fact that it is strictly necessary in the shifting device that the amount of displacement of a pair blanket cylinders between themselves and the amount of displacement of the pair of blanket cylinders between these blanket cylinders and an impression cylinder is small so that it does not exceed the tooth height of each gear referred to above. The necessity of setting the amount of displacement of the pair of blanket cylinders to such a low level resides in the following. In offset printing, it is necessary that throw-off positions where the pair of blanket cylinders are separated from each other and from any other cylinders be provided between an ultimate position for conducting blanket to blanket type printing and an ultimate position for conducting satellite type printing. It is necessary in a throw-off operation that the gears in driving systems be properly engaged with one another so that the transmission of power by the driving system for either blanket to blanket type printing or satellite type printing can be effected. If the gears are not engaged with one another properly in such a case, backlash necessarily occurs so that the power transmitting functions thereof are adversely affected.

The first problem referred to above may be solved by providing a method of increasing the amount of displacement of the pair of blanket cylinders to such an extent that it exceeds the tooth height of each driving gear. However, such an increase in the amount of displacement of the pair of blanket cylinders does not ensure a comparatively tight engagement of gears in driving systems in a throw-off position.

SUMMARY OF THE INVENTION

An object of the present invention is to solve the above-mentioned, apparently contradictory problems of increasing the amount of displacement of a pair of blanket cylinders and keeping the gears in driving systems in a comparatively tightly engaged state in a throw-off position.

Another object of the present invention is to provide a printing mode shifting device for printing cylinders in a rotary press, comprising a printing mode shifting means which permits shifting a blanket to blanket type printing mode to a satellite printing mode, and vice versa only by displacing a pair of blanket cylinders to omit gear shifting operations for the driving systems and which ensures a comparatively tight engagement of gears in the driving systems in a throw-off position.

A summary of the concept of the present invention resides in a printing mode shifting device wherein each part is constructed such as to allow the amount of displacement of a pair of blanket cylinders between two ultimate positions to exceed the tooth height of the driving gears for the cylinders which have operational relation with the pair cylinders; and two intermediate throw-off positions, i.e. a first intermediate position and a second intermediate position are provided close to a first ultimate position and a second ultimate position, respectively.

The above and other objects as well as advantageous features of the invention will become apparent from the following description of the preferred embodiment taken in conjunction with the accompanying drawings.

BRIEF DESCRIPTION OF THE DRAWINGS

The drawings attached hereto illustrate a printing mode shifting device for blanket cylinders in an offset rotary press embodying the present invention, wherein:

FIGS. 12, 14, 16 and 18 are side elevational views in longitudinal section taken along the line A—A in FIG. 8, and FIGS. 13, 15, 17 and 19 are side elevational views taken while facing the displacement mechanism in the direction of an arrow B—B in FIG. 8, wherein:

FIGS. 12 and 13 show the positional relation between principal parts of the blanket cylinder displacement mechanism in the blanket to blanket type printing mode shown in FIG. 4;

FIGS. 14 and 15 show the positional relation between principal parts of the blanket cylinder displacement mechanism in the first intermediate position shown in FIG. 5;

FIGS. 16 and 17 show the positional relation between principal parts of the blanket cylinder displacement mechanism in the second intermediate position shown in FIG. 6; and FIGS. 18 and 19 show the positional relation between principal parts of the blanket cylinder displacement mechanism in the satellite type printing mode shown in FIG. 7.

DESCRIPTION OF THE PREFERRED EMBODIMENT

The construction of a printing mode shifting device for blanket cylinders in a offset rotary press embodying the present invention will be described in detail with reference to the accompanying drawings.

Figure 1:
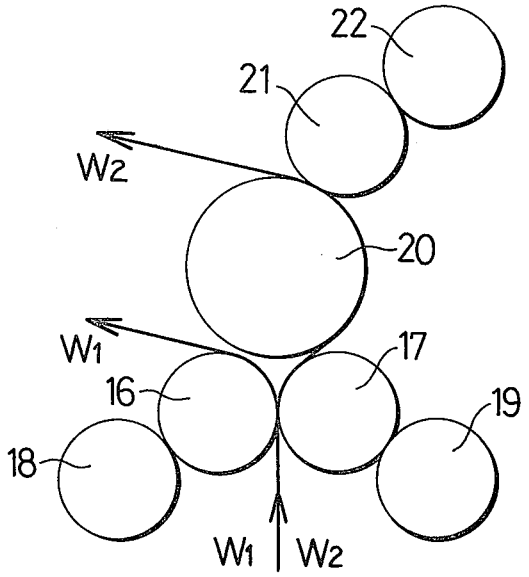
FIG. 1 is a schematic diagram illustrating the positional relation between a pair of blanket cylinders and between the pair of blanket cylinders and the other cylinders as well as the printing effect in a blanket to blanket type printing mode as one of the two ultimate positions of the pair of blanket cylinders.

FIG. 1 shows an arrangement of cylinders in a blanket to blanket type printing mode in which a pair of blanket cylinders are in first ultimate positions 16, 17. This arrangement has four series-contacting cylinders. Namely, the pair of blanket cylinders 16, 17 are in contact with each other and also with printing cylinders 18, 19, respectively, which cooperate therewith. In this arrangement, a common impression cylinder 20 is not in contact with the pair of blanket cylinders 16, 17. Reference numeral 21 denotes a third blanket cylinder which is in contact with the common impression cylinder 20 and a third printing cylinder 22. In this blanket to blanket type printing mode, both sides of a web $W_1$ are printed in one color. When the third blanket cylinder 21 is additionally used, one side of a web $W_2$ is printed in two colors, and the other side in one color.

Figure 2:
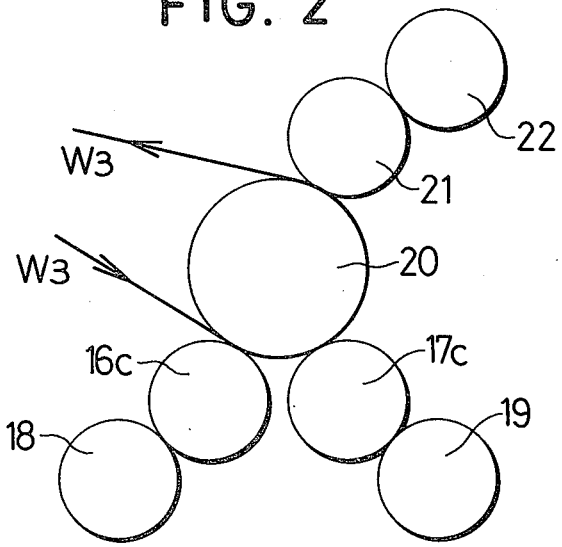
FIG. 2 is a schematic diagram illustrating the positional relation between the pair of blanket cylinders and between the pair of blanket cylinders and the other cylinders as well as the printing effect in a satellite type printing mode as the other ultimate position of the pair of blanket cylinders.

FIG. 2 shows an arrangement of cylinders in a satellite type printing mode in which the pair of blanket cylinders are in second ultimate positions **16*c*, 17*c*. This arrangement has five series-contacting cylinders. Namely, the pair of blanket cylinders 16*c*, 17*c* are not in contact with each other but in contact with the plate cylinders 18, 19, which cooperate therewith, and the common impression cylinder 20. In this printing mode, one side of a web $W_3$ can be printed in two colors. When the third blanket cylinder 21** is additionally used, one side of the web $W_3$ can be printed in three colors.

Figure 3:
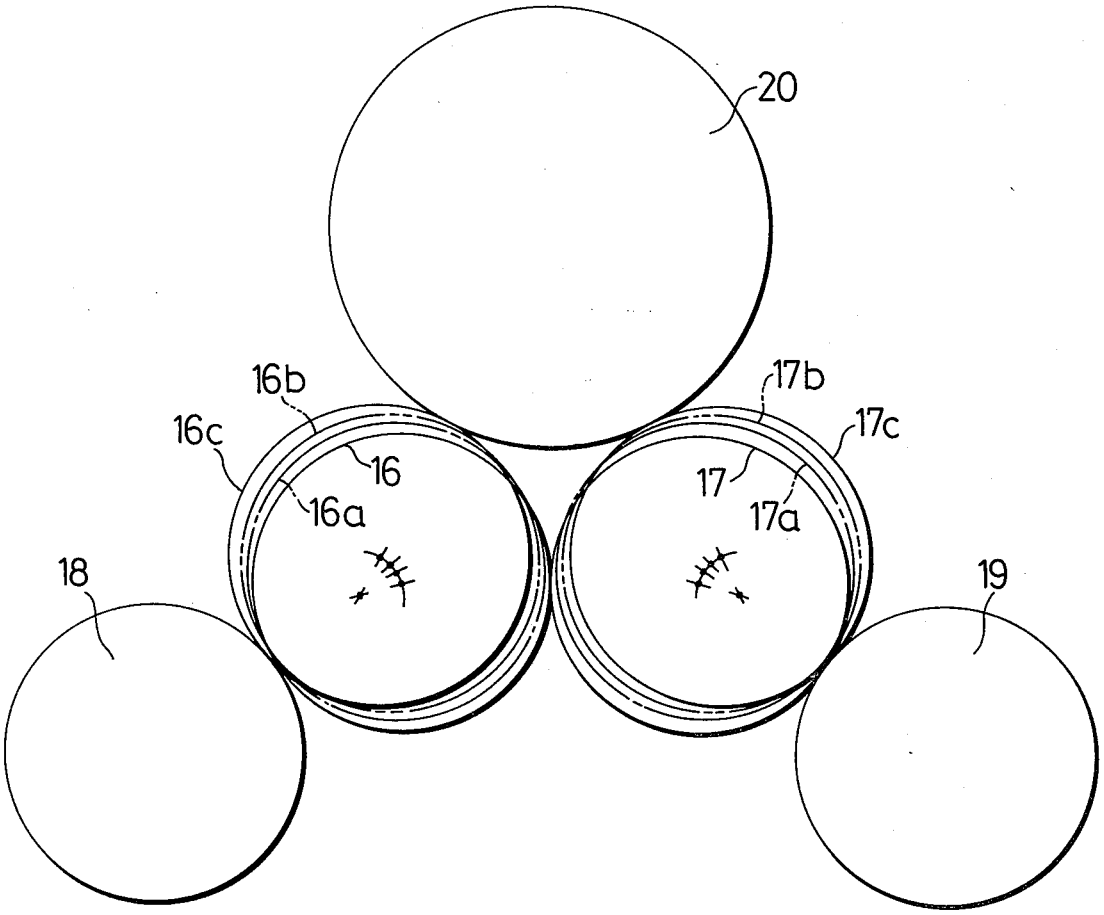
FIG. 3 is an enlarged schematic diagram illustrating the positional relation between the pair of blanket cylinders and between the pair of blanket cylinders and other cylinders in two ultimate positions and two intermediate positions.

FIG. 3 illustrates the positions of the pair of blanket cylinders in each stage of displacement thereof achievable by the present invention. Reference numerals 16, 17 denote first ultimate positions of the pair of blanket cylinders shown in FIG. 1, in which printing in a blanket to blanket printing mode is carried out; **16*a*, 17*a* first intermediate positions provided close to the positions 16, 17 referred to above; 16*b*, 17*b* second intermediate positions provided close to positions in which printing in a satellite printing mode is carried out; and 16*c*, 17*c*** second ultimate positions shown in FIG. 2, in which printing in the satellite printing mode is carried out.

Figure 4:
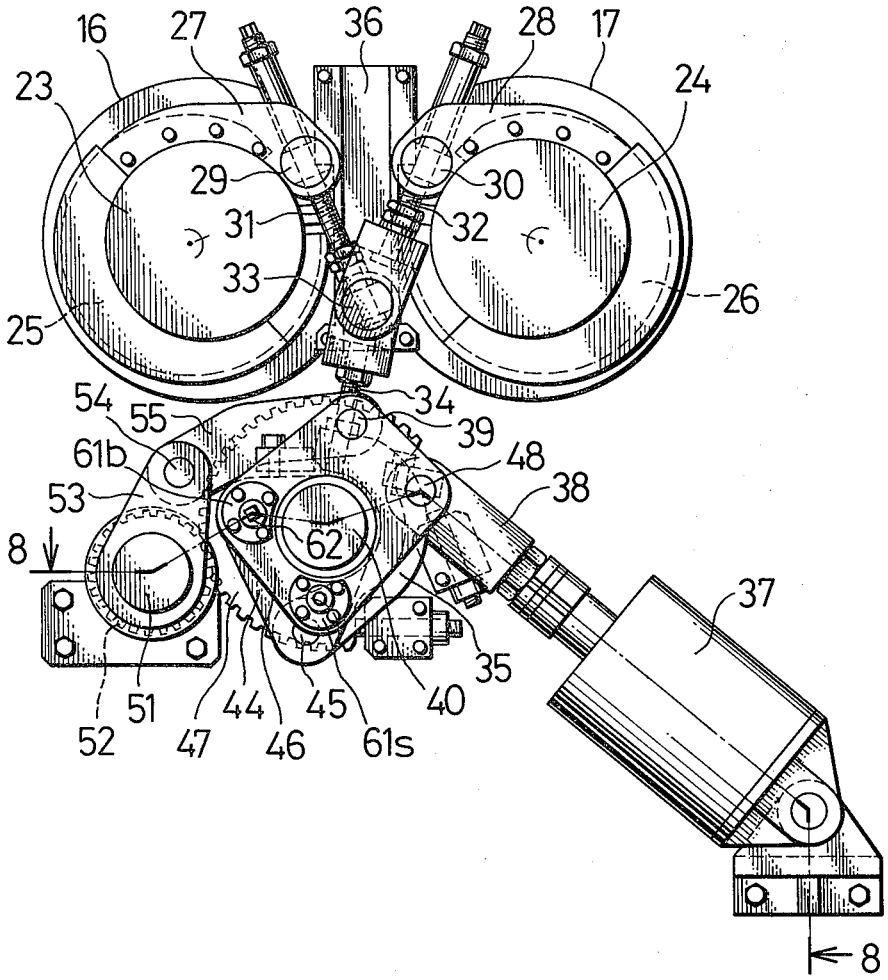
FIG. 4 is a side elevational view in section illustrating the positional relation between each part of a displacement mechanism for the blanket cylinders in a blanket to blanket type printing mode shown in FIG. 1.
Figure 5:
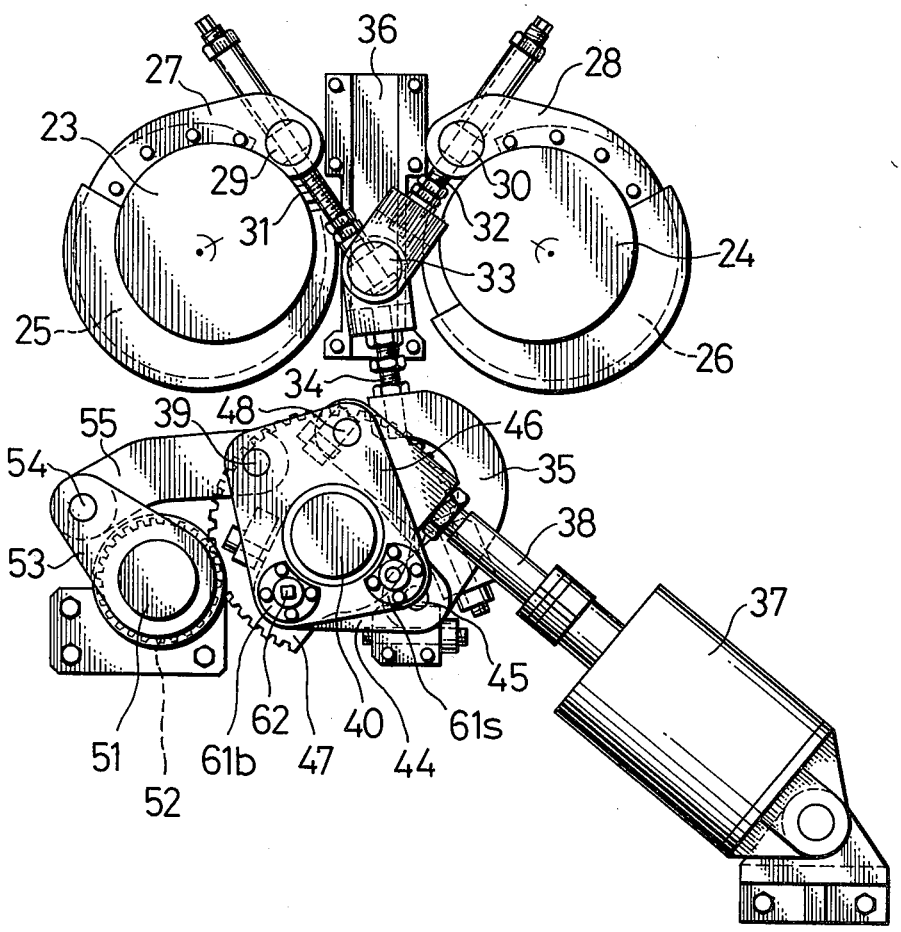
FIG. 5 is a side elevational view in section illustrating the positional relation between each part of the displacement mechanism shown in FIG. 4 in a first intermediate position close to the first ultimate position for blanket to blanket type printing.
Figure 6:
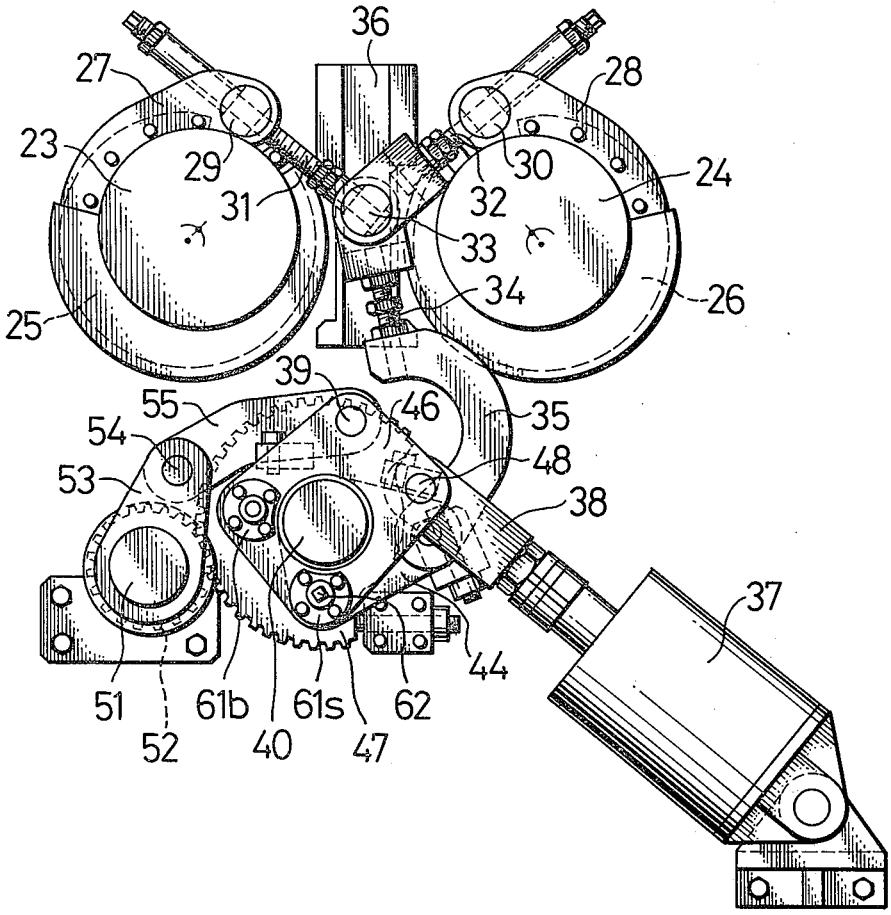
FIG. 6 is a side elevational view in section illustrating the positional relation between each part of the displacement mechanism shown in FIG. 4 in a second intermediate position close to the second ultimate position for satellite type printing.

FIG. 4 illustrates the positions of each part of a displacement mechanism in a blanket to blanket printing mode in which the pair of blanket cylinders are in positions 16, 17 in FIG. 3; FIG. 5 the positions of each part of the displacement mechanism when the pair of blanket cylinders are in positions **16*a*, 17*a* in FIG. 3 or in the first intermediate positions; FIG. 6 the positions of each part of the displacement mechanism when the pair of blanket cylinders are in positions 16*b*, 17*b* in FIG. 3 or in the second intermediate positions; and FIG. 7 in a satellite printing mode in which the pair blanket cylinders are in positions 16*c*, 17*c*** in FIG. 3.

A known eccentric mechanism for moving the pair of blanket cylinders and a link mechanism for remote-controlling the eccentric mechanism will be described.

Referring to FIGS. 4–7, both ends 23, 23; 24, 24 of the pair of blanket cylinders are supported on eccentric sleeves 25, 25; 26, 26 (eccentric sleeves 25, 26 on the opposite side are not shown). Brackets 27, 28 are projected from the eccentric sleeves 25, 26, which brackets 27, 28 are connected via pivots 29, 30 to length adjustment variable links 31, 32, respectively. The links 31, 32 meet with each other at lower end portions thereof to be pivotally connected to a common connector curb pivot 33. The pivot 33 is connected to a curved link 35 via a turn buckle 34 connected to the pivot 33. Reference numeral 36 denotes a guide groove adapted to guide the connector curb pivot 33 and fixed to the surface of a side frame.

When the curved link 35 is drawn to a lower ultimate position as shown in FIG. 4, the pair of links 31, 32 are brought close to each other in the shape of a letter "V" so that the eccentric sleeves 25, 26 are displaced at an equal angle in the opposite directions. As a result, the pair of blanket cylinders are brought into contact with each other as shown in FIGS. 1 and 3. Thus, the four cylinders 18, 16, 17, 19 exclusive of the pressure cylinder 20 are connected in series so that a blanket to blanket type printing is ready to be conducted.

Figure 7:
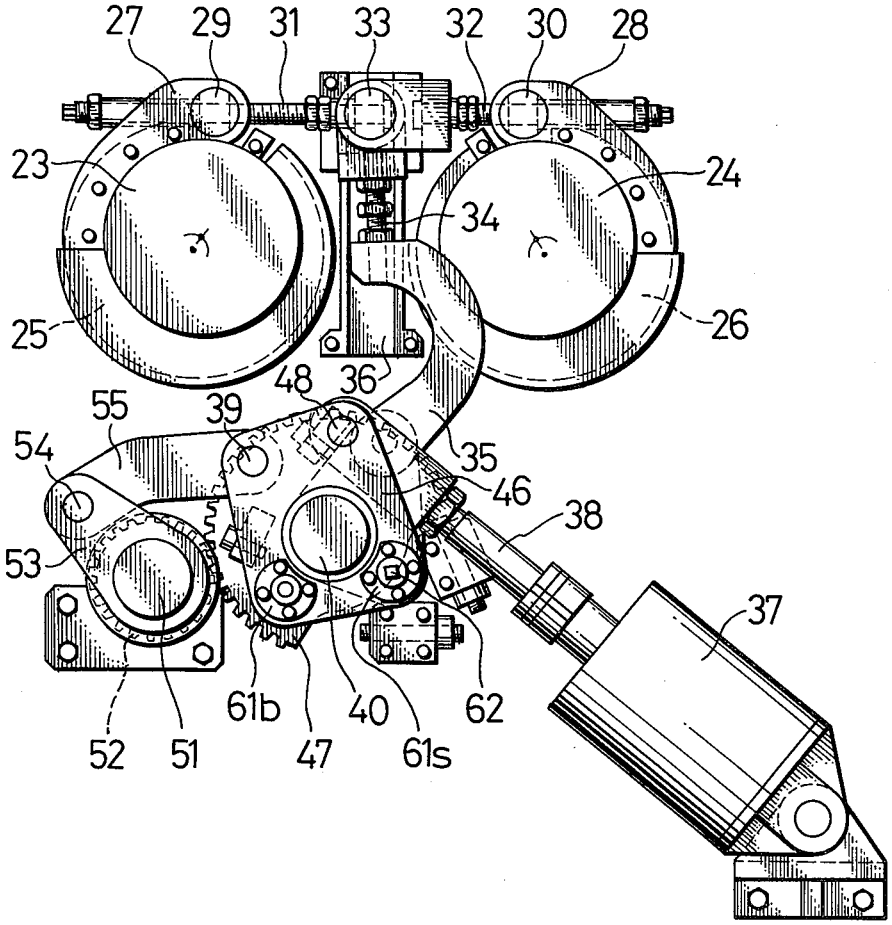
FIG. 7 is a side elevational view in section illustrating the positional relation between each part of the displacement mechanism shown in FIG. 4 in a satellite printing mode shown in FIG. 2.

On the other hand, when the curved link 35 is pushed to an upper ultimate position as shown in FIG. 7, the pair of links 31, 32 are opened in a straight line so that the pair of links 25, 26 are displaced at an equal angle in the opposite directions. As a result, the pair of blanket cylinders are separated from each other as shown in FIGS. 2 and 3. Thus, five cylinders 18, 16*c*, 20, 17*c*, 19, which include the impression cylinder 20, are connected in series so that a satellite type printing is ready to be conducted.

The curved link 35 is displaced by pushing and drawing the same by a piston rod 38 fitted into an air cylinder 37. However, when a starting end portion of the curved link 35 is connected directly in a simple manner to a front end portion of the piston rod 38, it is utterly impossible that the eccentric sleeves 25, 26 be displaced at a large angle at one stroke of the rod 38 fitted into the air cylinder 37.

Therefore, according to the present invention, the distance between the upper and lower ultimate positions as shown in FIGS. 4 and 7 is set to such a level that can be covered by the rod, which is fitted into the cylinder 37, at three strokes thereof. As a result, the teeth of a gear train, whereby the blanket cylinders, impression cylinders and plate cylinders are connected to one another, can be engaged and disengaged satisfactorily by such a large stroke action only of the rod 38, to thereby omit all engagement shifting operations for drive gears. At the same time, two points, between the upper and lower ultimate positions, to which the stroke actions of the rod 38 are turned back from the ultimate positions are utilized as a first intermediate throw-off position (FIG. 5) and a second intermediate throw-off position (FIG. 6). In each of these intermediate throw-off positions, the gears in each drive system are engaged with one another comparatively smoothly in spite of a large displacement of the rod 38 referred to above, so that the blanket cylinders, impression cylinders and plate cylinders can be rotated smoothly during the throw-off operations.

Figure 8:
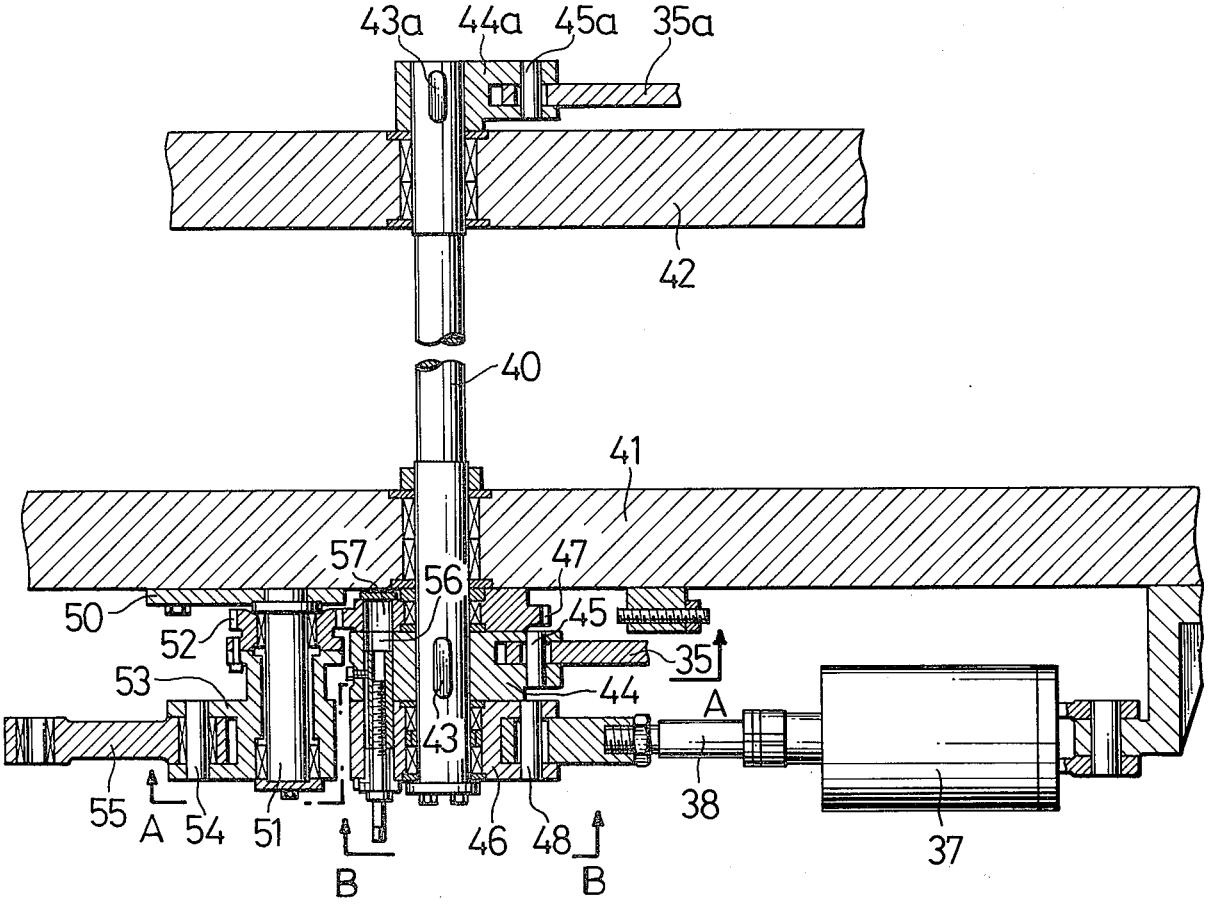
FIG. 8 is a plan view in cross section taken along the line 8—8 in FIG. 4.

Referring to FIG. 8, a cross shaft 40 is rotatably supported on right and left frames 41, 42 via bearings, and crank arms 44, 44*a* are secured to both end portions of the shaft 40 via keys 43, 43*a*, respectively. The crank arms are connected at their front end portions to the above-mentioned curved links 35, 35*a* via pins 45, 45*a*, respectively.

A disc type member 46 and a driven relay gear, i.e. a segment gear 47 in the embodiment shown in the drawings are in slide contact with both side surfaces of one crank arm 44 secured to one end portion of the cross shaft 40. The member 46 and gear 47 are oscillatably mounted on the cross shaft 40 via bearings.

Since the disc type member 46 is connected at its one outer end portion to the front end portion of the piston rod 38, which is fitted in the above-mentioned air cylinder 37, via a pin 48, the reciprocating linear movement of the rod 38 is converted into oscillatory movements of parts connected thereto, by the disc type member 46.

On the other hand, a shaft 51 is planted in a bracket 50 provided on the outer surface of the side frame 41, and a relay gear, i.e. a pinion 52 is rotatably mounted on the shaft 51. A boss portion of an arm 53 which is integrally formed with the pinion 52 is also oscillatably mounted on the shaft 51. The arm 53 is connected at the other end portion thereof to a fourth outer end portion of the disc type member 46 with a pin 39 via a pin 54 and a link 55. Accordingly, the pinion 52 is oscillated always in the same direction as the disc type member 46 owing to the operation of the link 55 and arm 53.

Since the segment gear 47 is engaged with the pinion 52, it is oscillated always in a direction opposite to the direction in which the disc type member 46 is oscillated.

As may be understood from the above-described construction, the clutch may be operated in the following manner. At a first forward stroke of the piston rod 38, the clutch is operated such that a direct forward oscillatory power can be transmitted to the crank arm 44. At a backward stroke of the piston rod 38, the clutch is operated such that the crank arm 44 can be disengaged from the disc type member 46 to receive an indirect backward oscillatory power from the segment gear 47. At a second forward stroke of the piston rod 38, the clutch is operated such that the crank arm 44 can be disconnected from the segment gear 47 to receive again a power from the disc type member 46. Thus, the driven member can be brought into engagement with the disc type member, segment gear and then disc type member so as to be moved always in the same direction in spite of a long displacement stroke of the eccentric sleeves 25, 26. Therefore, when these operations are collectively utilized, the amount of displacement of the pair blanket cylinders can be increased.

It is necessary that the clutch mechanism which permits attaining the above operations consists of a one which is capable of switching powers from two systems by exclusively selecting one of them. The embodiment shown in the drawings employs a pin clutch mechanism wherein a clutch pin is inserted into different bores. The above operation can also be attained by using a claw clutch.

An example of a pin clutch will be described with reference to the drawings.

The disc type member 46 is provided at another outer end portion thereof with a pair of bores 49*b*, 49*s* for inserting therein a clutch pin on the driving side. The bore 49*b* is used exclusively for printing in a blanket to blanket printing mode and the displacement of the pair of blanket cylinders between the first ultimate position and the first intermediate position. The bore 49*s* is used exclusively for printing in a satellite printing mode and the displacement of pair blanket cylinders between the second ultimate position and the second intermediate position.

Accordingly, the angle of opening of each of these bores with respect to the axis of the shaft 40 is equal to the sum of an angle of displacement of the disc type member 46 caused by one stroke of the piston rod 38 fitted into the air cylinder 37 and an angle of displacement of the segment gear 47 caused by one stroke of the piston 38. Namely, when the angles of displacement of the disc type member 46 and segment gear 47 caused by one stroke of the rod 38 are 60° and 30°, respectively, the angle of opening of each of the bores 49*b*, 49*s* is 90°.

The above numerical values are based on the assumption that the speed ratio of the segment gear 47 to pinion 52 and the ratio of the segment gear 47 to pinion 52 and the ratio of radius of oscillation of the pin 48 in the disc type member 46 to the pin 54 in the arm 53 integrally formed with the pinion 52 are 1:2 and 1:1, respectively.

On the other hand, the crank arm 44 is provided with a bore 56 for inserting therein a clutch pin on the driven side, which bore 56 is extended in the same radial direction as the bores **49*b*, 49*s* in the disc type member 46**.

The segment gear 47 is also provided with a bore 57 for inserting therein a clutch pin on the relay side, which bore 57 is extended in the same radial direction as the bores **49*b*, 49*s*. The phase of the bore 57 is set such that the bore 57 is aligned with one clutch pin insertion bore 49*b* in the disc type member 46 in a first dead point where a first stroke of the rod 38 fitted into the air cylinder 37 has been completed, and such that the bore 57 is aligned with the other clutch pin insertion bore 49*s* in the disc type member 46 in a second dead point where a second stroke of the rod 38** has been completed.

A clutch pin 58 is inserted at all times in the bore 56 on the driven side. When the clutch pin 58 is inserted into both the bore 56 and bore **49*b* or 49*s* on the driving side, it is completely disengaged from the bore 57 on the relay side. When the clutch pin 58 is inserted into both the bore 56 and bore 57 on the relay side, it is completely desengaged from both of the bores on the drive side. The clutch pin 58 is long enough to be inserted into the bores 56, 49*b*, 49*s*, 57** in the above-mentioned manner.

A means for displacing the clutch pin 58 in the lengthwise direction will be described.

Figure 9:
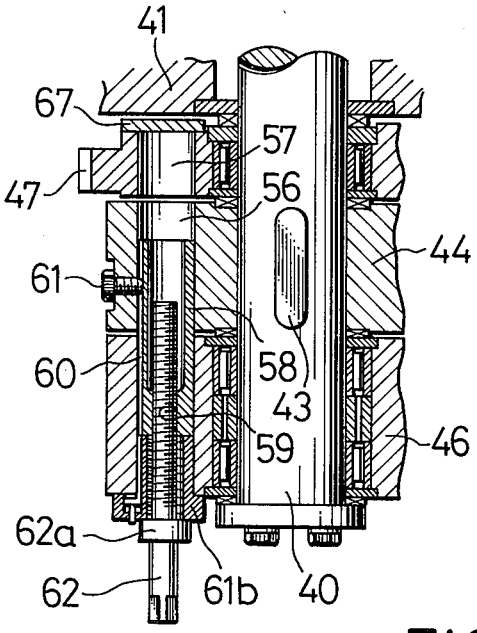
FIG. 9 is an enlarged view of a principal portion of FIG. 8, illustrating a position to which a clutch pin is shifted when the pair of blanket cylinders are shifted from the first ultimate position to the first intermediate position, and vice versa and from the second ultimate position to the second intermediate position, and vice versa.
Figure 10:
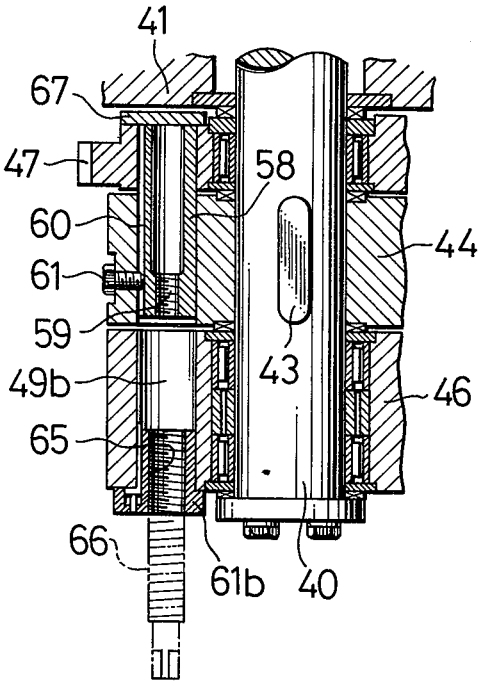
FIG. 10 is an enlarged view of a principal portion of FIG. 8, illustrating a position to which a clutch pin is shifted when the pair of blanket cylinders are shifted from the first intermediate position to the second intermediate position, and vice versa.

As shown in FIGS. 8–10, the clutch pin 58 consists of a cylinder having an axially extended female screw bore 59 in the inner surface thereof and an axially extended anti-rotation groove 60 in the outer surface thereof. An anti-rotation screw 61, which is projected from the crank arm 44 into the bore 56, is fitted at its inner end portion into the groove 60 so that the pin 58 can be moved to right and left in the direction of the length of the bore 56 owing to the operation of the screw 61 fitted into the groove 60.

Sleeves **61*b*, 61*s* are fixedly fitted into the open end portions of the bores 49*b*, 49*s* on the driving side. In order to withdraw the pin 58 from the bore 57 on the relay side and move the same toward the bore 49*b* or 49*s*, a pinwithdrawing screw rod 62 having a collar 62*a* is screwed into the female screw bore 59 as shown in FIG. 9. At this time, an excessive entry of the screw rod 62 into the female screw bore 59 is prevented by the collar 62*a* which is integrally formed with the screw rod 62 and which comes into contact with the outer end surface of the sleeve 61*b* or 61*s*. The pin 58 is displaced in the lengthwise direction as the screw rod 62 is turned to right, so that the pin 58 is withdrawn from the bore 57 on the relay side and moved toward, for example, the bore 49*b* on the driving side. As a result, the crank arm 44 comes into engagement with the disc type member 46**.

Figure 11:
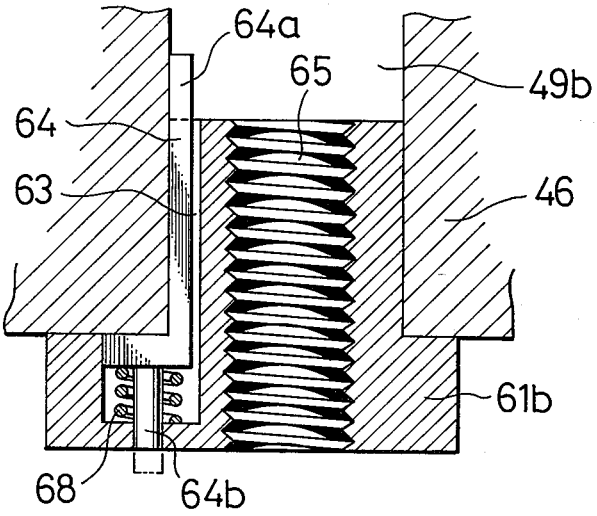
FIG. 11 is an enlarged plan view in cross section of a mechanism for use in ascertaining that a clutch pin has been shifted to an ultimate position shown in FIG. 9.

FIG. 11 shows an indicator for enabling the operator to ascertain that the clutch pin 58 has entered the bore **49*b* on the driving side to a sufficient extent and removed completely from the bore 57** on the relay side.

In this indicator, a groove 63 is provided in the outer surface of the sleeve **61*b*, which groove 63 is extended in the direction of the axis of the sleeve 61*b*. A contactor 64 is fitted into the groove 63. A spring 68 is provided to project an inner end portion 64*a* of the contactor 64 into the bore 49*b*. When the inner end portion 64*a* is urged by the end surface of the clutch pin 58 to be outwardly displaced against the spring 68, an outer end portion 64*b* of the contactor 64** is projected outside. This can be visually ascertained by the operator.

In order to engage the crank arm 44 with the relay gear 47, a control screw rod 66 is screwed into a female screw 65 provided in the inner circumferential surface of the sleeve **61*b* to press an end surface of the clutch pin 58 at the front end surface of the screw rod 66 to displace the clutch pin 58. As a result, the clutch pin 58 collides at its inner end surface with a stopper 67 to be stopped. The stopping of the clutch pin 58 indicates that the shifting of the clutch pin 58** has been attained.

The operation of the present invention will be described.

When a printing operation is conducted in a blanket to blanket printing mode, the pair of blanket cylinders 16, 17 are in positions shown in FIG. 1, and each part of the displacement mechanism is positioned as shown in FIGS. 4, 9, 12 and 13. Namely, the piston rod 38 fitted into the air cylinder 37 is in an ultimate retraction position, and the clutch pin 58 is engaged with both the bore **49*b* in the disc type member 46 and the bore 56 in the crank arm 44 and completely removed from the bore 57 in the segment gear 47. Accordingly, the displacement of the pistion rod 38 is directly transmitted to the curved link 35. This allows the pair of sleeves 25, 26 to be in the first ultimate position as shown in FIG. 4**.

When the piston rod 38 is extended by a one-stroke distance from the first ultimate position to an ultimate extension position, each part of the displacement mechanism is positioned as shown in FIGS. 5, 9, 14 and 15. Namely, the pair blanket cylinders are displaced to positions **16*a*, 17*a* shown in FIG. 3**, i.e. the first intermediate throw-off position where the pair of blanket cylinders are separated from each other and from any other cylinders.

In this case, the clutch pin insertion bore 56 in the crank arm 44 is aligned with the bore **49*b* in the disc type member 46 by the clutch pin 59. This shows that the bore 56 has been displaced by an angle which is equal to the angle, for example, 60°, of the position of the bore 49*b* in the disc type member 46**.

On the other hand, the clutch pin insertion bore 57 in the segment gear 47 has been oscillated by an angle equal the angle of displacement thereof, for example, 30° in a direction opposite to the direction in which the bore 56 is displaced, since the segment gear is engaged with the pinion 52. Therefore, in order that the bores 56, 57 be aligned with each other, it is necessary that an initial phase difference between the bores 56, 57 be equal to the sum of the angles of displacement of the two bores, i.e. 90° (60°+30°=90°). Assuming that these two bores 56, 57 are provided in positions where the above initial phase difference requirement is satisfied, they will be exactly aligned with each other in the first intermediate throw-off position. As a result, that portion of the clutch pin 58 which is in the bore **49*b* in the disc type member 46 is pushed smoothly in the inward direction as shown in FIG. 10 by the control screw rod 66 so that the bore 56 in the crank arm 44 and the bore 57 in the segment gear 47 are aligned with each other for attaining the shifting of the clutch pin 58**.

After the clutch pin 58 has been shifted in the above-mentioned manner, the piston rod 38 fitted into the air cylinder 37 is returned by a second stroke thereof from the ultimate extension position to the ultimate retraction position. In this case, the clutch is engaged such as to form a power transmission passage via the segment gear 47. Therefore, the displacement of the piston rod 38 is transmitted backwardly via the disc type member 46, link 55, arm 53 and pinion 52 despite the fact that the rod 38 is backwardly displaced. As a result, the pair of eccentric sleeves 25, 26 is displaced angularly in the same direction as in the preceding stage of displacement of the rod 38 so that the rod 38 reaches the second intermediate throw-off position. The above may be understood when FIGS. 14 and 15 and FIGS. 16 and 17 are referred to in comparison with one another.

Figure 12:
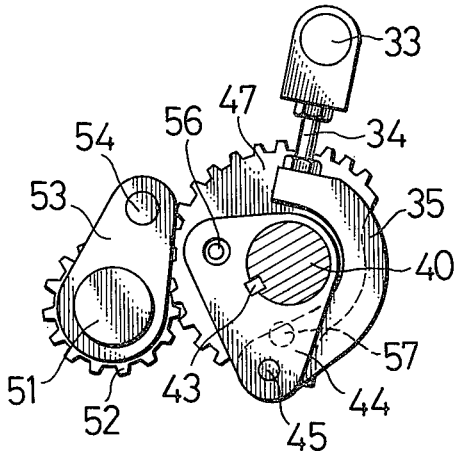
Figure 13:
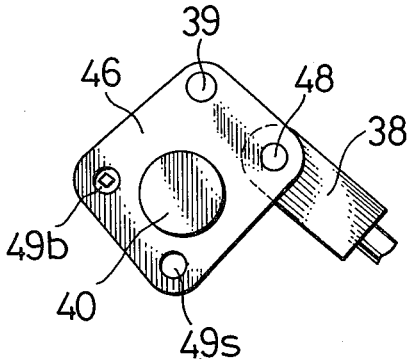
Figure 14:
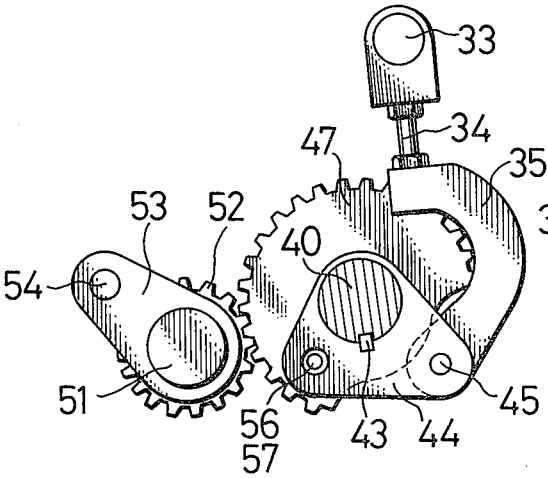
Figure 15:
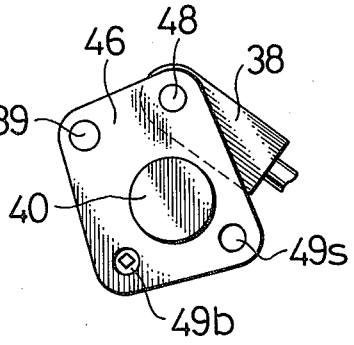
Figure 16:
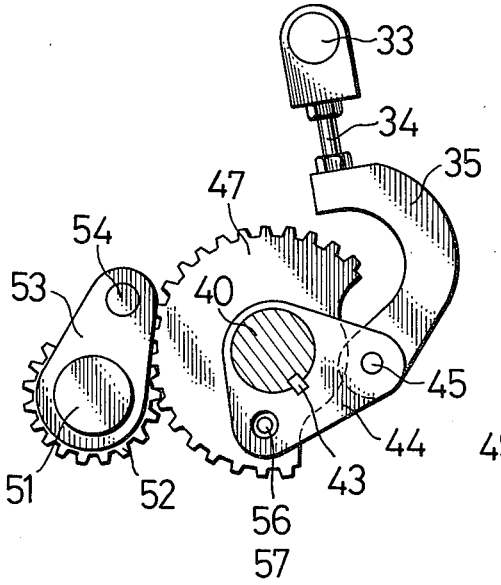
Figure 17:
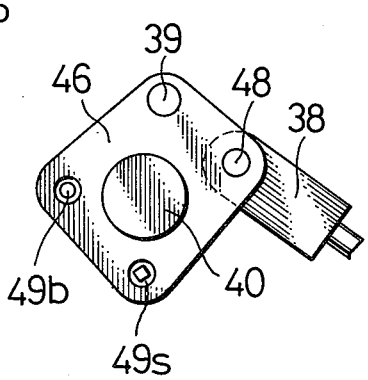
Figure 18:
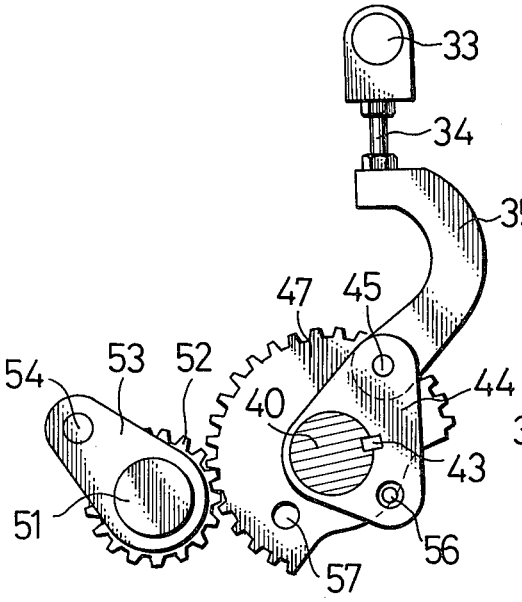
Figure 19:
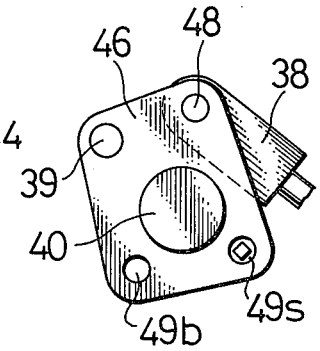

When the angles of opening of the clutch pin insertion bores 49*b*, 49*s* provided in the disc type member 46 is set to 90° which is the sum of the angle of displacement, 60°, of the disc type member 46 caused by one stroke of the rod 38 and the angle of displacement, 30°, of the segment gear 47 caused by one stroke of the rod 38; and the conversion factor on the basis of which an amount of linear displacement of the piston rod 38 at one stroke thereof is converted into an amount of angular displacement of the rod 38 with respect to the axis of the cross shaft 40 is set to 60°, the clutch pin insertion bore 56 in the crank arm 44, which is initially in the same phase as one clutch pin insertion bore 49*b* in the disc type member 46 as shown in FIGS. 12 and 13, is oscillated counterclockwise at 60° as shown in FIGS. 14 and 15 when the rod 38 is in the first dead point where one stroke thereof has been completed. When the rod 38 is in the second dead point where two strokes thereof have been completed, the bore 56 is further oscillated counterclockwise at 30° as shown in FIGS. 16 and 17. Thus, the bore 56 is oscillated at 90° in total at two strokes of the rod 38.

In the meantime, the disc type member 46 is oscillated forwardly at 60° and backwardly 60° so that two bores 49*b*, 49*s* which have an angle of opening of 90° are returned to the first phase in which they are initially positioned. Accordingly, the bore 56 in the crank arm 44 which has been oscillated at 90° as shown in FIGS. 16 and 17 agrees in phase, when the rod 38 is in the second intermediate throw-off position, with the second clutch pin insertion bore 49*s*, or the bores 56, 49*s* are aligned with each other. When the clutch pin 58 is then moved toward the bore 49*s*, which is in alignment with the bore 56, by using the control rod 62 in the same manner as shown in FIG. 9, the power transmission system is shifted again in the same rotational direction.

After the transfer of the clutch pin 58 has been completed, the pair of blanket cylinders can be easily displaced from the second throw-off position to the second ultimate position, i.e. a position for satellite type printing, shown in FIGS. 18, 19, 7, 2 and 3 (at 16*c* and 17*c*). The displacement can be attained by extending the piston rod 38 by its third stroke to be returned to the ultimate extension position again.

An operation for shifting the power transmission system from the second ultimate position to the first ultimate position via the second intermediate throw-off position and first intermediate throw-off position can be carried out by reversing the procedure described above.

The numerical values included in the above description of the embodiment are used as mere examples; the numerical values used in the present invention are not necessarily the same as those included in the above description.

According to the present invention, the construction and operation of which are described in detail above, the distance between two ultimate positions of the pair of blanket cylinders, i.e. the distance of displacement of the pair of blanket cylinders between a position for carrying out printing in a blanket to blanket printing mode and a position for carrying out printing in a satellite printing mode is far greater than that in a conventional printing mode shifting device. The distance of displacement of these blanket cylinders is greater than the tooth height of drive gears (not shown) related to the displacement of the pair of blanket cylinders, which tooth height is necessary for the engagement of these drive gears. Therefore, the shifting of printing modes can be effected by merely displacing the pair of blanket cylinders, and operations as in a conventional device of this kind for the axial engagement and disengagement between the gear for the impression cylinder and the gear for one of the pair of blanket cylinders can be omitted. This allows the printing mode shifting device according to the present invention to be constructed simply and manufactured at a low cost. Since the device according to the present invention can be operated by driving a single means, it can be handled very easily, and operation errors never occur.

Accordingly to the present invention, intermediate positions, i.e. throw-off positions where the pair of blanket cylinders are separated from each other and from any other cylinders are provided in two points between the above-mentioned two ultimate positions. The first intermediate position is provided close to the first ultimate position, and the second intermediate position close to the second ultimate position. As a result, the driving systems for the cylinders are not disengaged from one another during a throw-off operation. In other words, the driving gears for all cylinders are engaged with one another orderly so that backlash never occurs. Thus, the present invention allows the power transmission systems to be operated reliably even in a throw-off operation.

The present invention has some secondary advantages which should not be overlooked: it has a remarkably wide gap between the pair of blanket cylinders and impression cylinder, a remarkably large distance of displacement of the pair of blanket cylinders, and two intermediate throw-off positions. This permits the attaching and detaching of a printing plate, cleaning of cylinders, insertion of a web and removal of broken web to be easily carried out.

The present invention is not, of course, limited to the above-described embodiment; it may be modified in various ways within the scope of the appended claims.

I claim:

1. A printing mode shifting device for blanket cylinders in a rotary press which has cylinders arranged generally cross-sectionally in the shape of an equilateral triangle and including two plate cylinders disposed at two vertexes of the equilateral triangle, an impression cylinder disposed at the remaining vertex of the equilateral triangle, and blanket cylinders disposed between said plate cylinders and said impression cylinder, eccentric sleeves provided at support portions at both ends of said blanket cylinders, and a common link mechanism for displacing said blanket cylinders with respect to each other and with respect to the other cylinders simultaneously and which permits obtaining two ultimate positions, a first of which is a blanket to blanket type printing mode with four series-contacting cylinders exclusive of the impression cylinder, and a second of which is a satellite type printing mode with five series-contacting cylinders including the impression cylinder, said shifting device comprising a cross shaft rotatably supported on right and left side frames, a pair of crank arms fixedly mounted on both end portions of said link mechanism, a reciprocating actuator, a conversion member provided at one side of one of said crank arms, rotatably supported on said cross shaft, and connected at one outer end portion thereof to a rod of said actuator to convert linear reciprocating movements of said rod into oscillatory movements, a relay gear rotatably mounted on a shaft projected from the outer surface of one of said side frames, and connected to said conversion member so as to be oscillated in the same direction as said conversion member, a driven relay gear engaged with said relay gear, rotatably mounted on said cross shaft, and positioned at the other side of said crank arm, a clutch for transmitting from said conversion member to said one of the crank arms to select two opposite rotations, one of which transmits direct rotation when said blanket cylinders are displaced between a first ultimate position and a first intermediate throw-off position and between a second ultimate position and a second intermediate throw-off position, and another of which transmits reverse rotation when said blanket cylinders are displaced between said first intermediate throw-off position and said second intermediate throw-off position, said blanket cylinders being displaceable between said first ultimate position and said second ultimate position through said first and second intermediate throw-off positions, the amount of displacement of said blanket cylinders between the two ultimate positions exceeding the tooth height of the driving gears for said blanket cylinders and the cylinders contacting with said blanket cylinders, and said first intermediate throw-off position being provided close to said first ultimate position and keeping gearing within a gear train in said first ultimate position; and said second intermediate throw-off position being provided close to said second ultimate position and keeping gearing within a gear train in said second ultimate position.

2. A printing mode shifting device for blanket cylinders in a rotary press which has cylinders arranged generally cross-sectionally in the shape of an equilateral triangle and including two plate cylinders disposed at two vertexes of the equilateral triangle, an impression cylinder disposed at the remaining vertex of the equilateral triangle, and blanket cylinders disposed between said plate cylinders and said impression cylinder, eccentric sleeves provided at support portions at both ends of said blanket cylinders, and a common link mechanism for displacing said blanket cylinders with respect to each other and with respect to the other cylinders simultaneously and which permits obtaining two ultimate positions, a first of which is a blanket to blanket type printing mode with four series-contacting cylinders exclusive of the impression cylinder, and second of which is a satellite type printing mode with five series-contacting cylinders including the impression cylinder, said shifting device comprising a cross shaft rotatably supported on right and left side frames; a pair of crank arms fixedly mounted on both end portions of said link mechanism; a reciprocating actuator, a disc type member slidably contacting at one side surface of one of said crank arms, rotatably supported on said cross shaft, and connected at one outer end portion thereof to a rod of said actuator to convert linear reciprocating movements of said rod into oscillatory movements, a relay gear rotatably mounted on a shaft projected from the outer surface of one of said side frames, and connected to said disc type member, a driven relay gear engaged with said relay gear, rotatably mounted on said cross shaft, and positioned at the other side of said crank arm, a pin clutch mechanism for transmitting from said disc type member to said one of the crank arms to select two opposite rotations, one of which transmits direct rotation when said blanket cylinders are displaced between a first ultimate position and a first intermediate throw-off position and between a second ultimate position and a second intermediate throw-off position, and another of which transmits reverse rotation when said blanket cylinders are displaced between said first intermediate throw-off position and said second intermediate throw-off position; said blanket cylinders being displaceable between said first ultimate position and said second ultimate position through said first and second intermediate throw-off positions, said pin clutch mechanism having a pair of clutch pin insertion bores on a drive side provided in two points in said disc type member, which have an angle of opening equal to the sum of an angle of displacement of said disc type member caused by one stroke of the rod of said actuator and an angle of displacement of said driven relay gear caused by one stroke of said rod, a clutch pin insertion bore on a driven side provided in one of said crank arms so as to be extended in the same radial direction as said clutch pin insertion bores on the drive side, a clutch pin insertion bore on a relay side provided in said driven relay gears so as to come into alignment with one of said clutch pin insertion bores in said disc type member in a first dead point where a first stroke of said rod has been completed and with the other bore in said disc type member in a second dead point where a second stroke of said rod has been completed, a clutch pin long enough to selectively communicate said bore on the driven side with one of said bores on the drive side or said bore on the relay side, and a control means for displacing said clutch pin in the direction of the length thereof, the amount of displacement of said blanket cylinders between the two ultimate positions exceeding the tooth height of the driving gears for said blanket cylinders and the cylinders contacting with said blanket cylinders, said first intermediate throw-off position being provided close to said first ultimate position and keeping gearing within a gear train in said first ultimate position, and said second intermediate throw-off position being provided close to said second ultimate position and keeping gearing within a gear train in said second ultimate position.

3. A printing mode shifting device according to claim 2, wherein said clutch pin control means consists of a member for preventing said clutch pin from being rotated in a bore, a clutch control rod inserted into the bore into which said clutch pin is inserted, a male screw rod provided on the front end of said clutch control rod, and a female screw axially extended from one end surface of said clutch pin, a lead pair by the engagement of said screws being utilized to displace the clutch pin in the bore in the lengthwise direction.

4. A printing mode shifting device according to claim 2, wherein said clutch pin control means consists of a member for preventing said clutch pin from being rotated in a bore, a sleeve having a female screw and fixedly fitted into an end portion of the bore, and a clutch control rod having a male screw thereon, a lead pair by the engagement of said screws being utilized to displace the clutch pin in the bore in the lengthwise direction by the front end surface of said clutch control rod.

* * * * *